United States Patent [19]

Schoennagel

[11] 4,316,794

[45] Feb. 23, 1982

[54] DIRECT CONVERSION OF RESIDUAL OILS

[75] Inventor: Hans J. Schoennagel, Lawrenceville, N.J.

[73] Assignee: Mobil Oil Corporation, New York, N.Y.

[21] Appl. No.: 127,612

[22] Filed: Mar. 6, 1980

[51] Int. Cl.[3] ..... C10G 11/18; C10G 47/28

[52] U.S. Cl. ..... 208/111; 208/108; 208/109; 208/110; 208/112; 208/120; 252/417

[58] Field of Search ..... 208/108–113; 252/417

[56] References Cited

U.S. PATENT DOCUMENTS

| | | | |
|---|---|---|---|
| 2,575,258 | 11/1951 | Corneil et al. | 208/52 CT |
| 3,393,145 | 7/1968 | Dill et al. | 208/59 |
| 3,412,013 | 11/1968 | Bowles | 208/120 |
| 3,424,672 | 1/1969 | Mitchell | 208/164 |
| 3,433,732 | 3/1969 | Leaman | 208/111 |
| 4,002,557 | 1/1977 | Owen et al. | 208/120 |

*Primary Examiner*—Delbert E. Gantz
*Assistant Examiner*—G. E. Schmitkons
*Attorney, Agent, or Firm*—C. A. Huggett; M. G. Gilman; D. P. Santini

[57] ABSTRACT

A process for the direct catalytic conversion of petroleum residual oils is disclosed wherein said oils, hydrogen and hot solid catalyst particles are contacted to form a suspension in a riser reactor thereby producing lower boiling components with the concomitant removal of impurities, e.g., metals, sulfur and nitrogen,, from the oils. Furthermore, the catalyst particles are regenerated in a partial oxidation mode, i.e. with oxygen and steam present to generate a synthesis gas comprising CO, $CO_2$ and $H_2$. Such synthesis gas can be subsequently shifted to produce a $H_2$—$CO_2$ rich gas which could then serve as the hydrogen source in the riser reactor.

16 Claims, 1 Drawing Figure

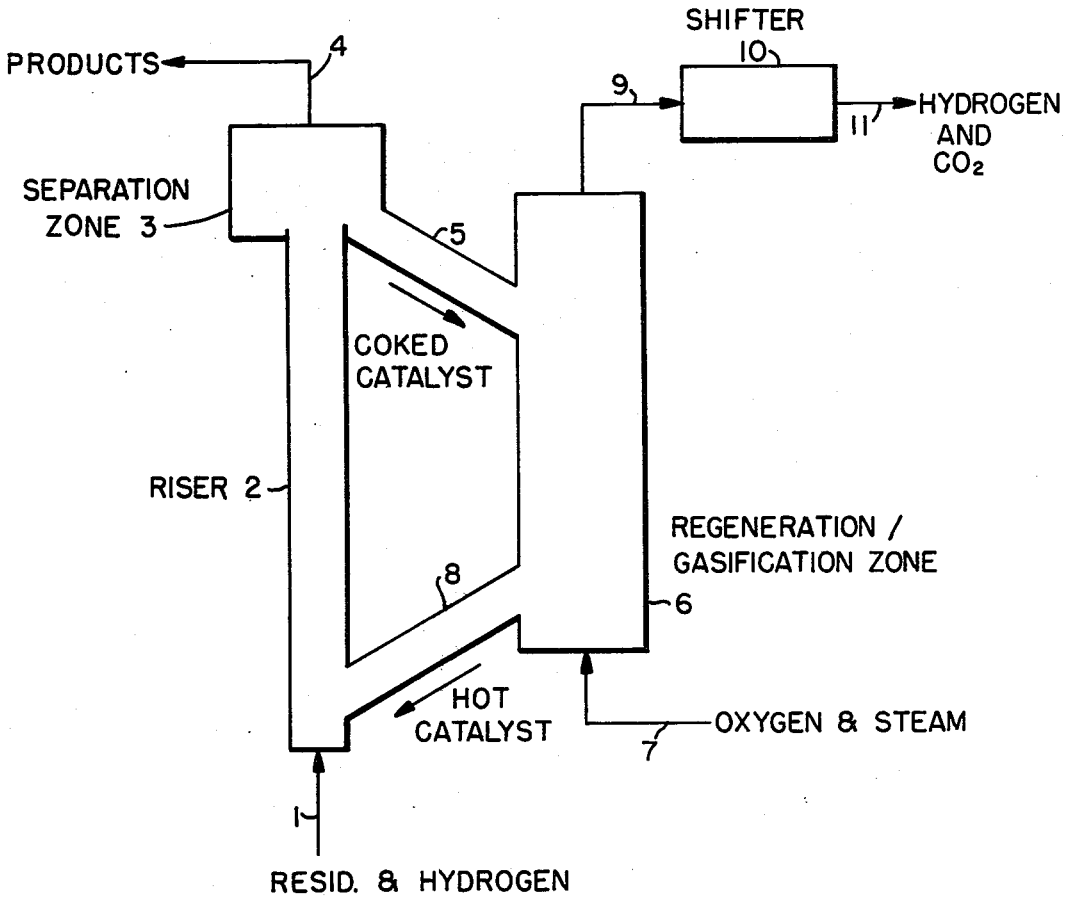
PRODUCTS
4
SHIFTER
10
9
11
HYDROGEN
AND
$CO_2$
SEPARATION
ZONE 3
5
COKED
CATALYST
RISER 2
REGENERATION /
GASIFICATION ZONE
8
6
HOT
CATALYST
OXYGEN & STEAM
7
1
RESID. & HYDROGEN

DIRECT CONVERSION OF RESIDUAL OILS

BACKGROUND OF THE INVENTION

1. Field of the Invention

This invention concerns the direct conversion of petroleum residua in the presence of hydrogen. More particularly, the present invention relates to a process for the catalytic upgrading of residual oils in the presence of hydrogen to obtain lower boiling components.

2. Description of the Prior Art

Current practice for upgrading high molecular weight, hydrogen-deficient, high-impurity refinery stocks generally involves either hydrotreating followed by catalytic cracking, or hydrocracking, both of which involve the use of hydrogen in high-pressure process units. The need to "hydrogen treat" residual petroleum fractions produced by atmospheric and vacuum distillation of crude petroleum is due to the high contaminant content of such fractions. During the distillation of crude oil most of the contaminants present in the crude remain in the residual fraction. Such contaminants include metals and non-metals.

Principal metal contaminants are nickel and vanadium, with iron and small amounts of copper sometimes present. Additionally, trace amounts of zinc and sodium are found in some feedstocks. The high metals content of the residual fractions generally preclude their effective utilization as charge stocks for subsequent catalytic processing, e.g., catalytic cracking. The metal contaminants tend to deposit on the special catalysts for these processes and cause the formation of inordinate amounts of coke, dry gas and hydrogen.

Non-metallic contaminants such as sulfur, nitrogen and CCR generally preclude the direct use of residual fractions as fuels due to environmental concerns, i.e. pollution.

At present, catalytic cracking is generally conducted utilizing hydrocarbon chargestocks lighter than residual fractions which generally have an API gravity less than 20. Typical cracking chargestocks are coker and/or crude unit gas oils, vacuum tower overhead, etc., the feedstock having an API gravity from about 15 to about 45. Since these cracking chargestocks are distillates, they do not contain significant proportion of the large molecules in which the metals are concentrated. Such cracking is commonly carried out in a reactor operated at a temperature of about 430° C. (800° F.) to 820° C. (1500° F.), a pressure of about 100 kPa (1 atm) to 510 kPa (5 atm), and a space velocity of about 1 to 1000 WHSV.

The amount of metals present in a given hydrocarbon stream is often expressed as a chargestock's "metals factor." This factor is equal to the sum of the metals concentrations, in parts per million, of iron and vanadium plus ten times the concentration of nickel and copper in parts per million, and is expressed in equation form as follows:

$$F_m = Fe + V + 10\,(\mathrm{Ni} + \mathrm{Cu})$$

Conventionally, a chargestock having a metals factor of 2.5 or less is considered particularly suitable for catalytic cracking. Nonetheless, streams with a metals factor of 2.5 to 25, or even 2.5 to 50, may be used to blend with, or as all of the feedstock to a catalytic cracker, since chargestocks with metals factors greater than 2.5 in some circumstances may be used to advantage, for instance with the new fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80% of the metals and preferably at least 90% needs to be removed to produce fractions (having a metals factor of about 2.5 to 50) suitable for cracking chargestocks.

Metals and sulfur contaminants present similar problems with regard to hydrocracking operations which are typically carried out on chargestocks even lighter than those charged to a cracking unit. Hydrocracking catalyst is so sensitive to metals poisoning that a preliminary or first stage is often utilized for trace metals removal. Typical hydrocracking reactor conditions consist of a temperature of 205° C. (400° F.) to 540° C. (1,000° F.) and a pressure of 790 kPa gage (100 psig) to 24,235 kPa gage (3,500 psig).

One method for catalytic cracking of residual oils is presented in U.S. Pat. No. 3,886,060. In this method, residual oil serves as a quench medium for limiting the conversion of a recycle oil product thereof in a riser conversion zone.

Catalytic conversion of metal containing residual feedstocks is described in various patents. A method for catalytically converting residual hydrocarbons containing greater than 1 ppm of metal contaminants in the presence of a low molecular weight carbon-hydrogen fragment contributing material and an acid zeolite catalyst is disclosed in U.S. Pat. No. 4,002,557. In U.S. Pat. No. 4,162,213, a process is described for catalytically cracking a metal-contaminated residual feedstock in the absence of hydrogen in a fluid cracking process wherein the regenerated catalyst has less than about 0.05 wt. % residual carbon.

SUMMARY OF THE INVENTION

Petroleum resid and hydrogen are charged to a riser reactor and rapidly heated by hot fluid catalyst to generate lower boiling components and more particularly a product comprising mononuclear aromatics and methane. A fraction of the resid feedstock is rejected as coke on the catalyst and is converted to a hydrogen containing gas in a catalyst regenerator, which operates as a partial oxidation gasifier. The clean, burned, hot catalyst is then fed to the riser reactor to complete the reaction cycle. The hydrogen containing gas undergoes water gas shift to form a shifted gas stream of predominantly hydrogen and carbon dioxide. Hydrogen may then be separated from the shifted gas stream and is thus available for use in the riser reactor. Alternatively, the hydrogen-rich shifted gas stream itself may be recycled back to the riser reactor.

In comparison to the competitive scheme of hydrotreating and subsequent cracking of resid in two separate operations, the process of the instant invention operates at much lower hydrogen pressures, i.e. less than 2515 kPa gage (350 psig), and thus lower capital costs are to be expected. Furthermore, the product spectrum of this process is expected to be quite different from that of cracking hydrotreated resid.

BRIEF DESCRIPTION OF THE DRAWING

The drawing shows diagrammatically one embodiment of the present invention. More particularly a system is shown which comprises two vessels with interconnecting transfer conduits for effecting catalytic conversion of petroleum resid in the presence of hydrogen, regeneration of the hydrocarbon conversion catalyst and transfer of catalyst particules within the system. The drawing further depicts a shifter to produce a predominantly hydrogen-carbon dioxide containing gas from the effluent gas of the catalyst regeneration.

DESCRIPTION OF PREFERRED EMBODIMENTS

The feedstock for this invention can be a whole crude. However, since the high metal and sulfur components of a crude oil tend to be concentrated in the higher boiling fractions, the present process more commonly will be applied to a bottoms fraction of a petroleum oil, i.e. one which is obtained by atmospheric distillation of a crude petroleum oil to remove lower boiling materials such as naphtha and furnace oil, or by vacuum distillation of an atmospheric residue to remove gas oil. Typical residues to which the present invention is applicable will normaly be substantially composed of residual hydrocarbons boiling about 345° C. (650° F.) and containing a substantial quantity of asphaltic materials. Thus, the chargestock can be one having an initial or 5 percent boiling point somewhat below 345° C. (650° F.). A hydrocarbon stock having a 50 percent boiling point of about 485° C. (900° F.) and which contains asphaltic materials, about 4 percent by weight sulfur and about 50 to 300 ppm nickel and vanadium is illustrative of such chargestock.

Catalysts useful herein contain active components which, depending on the gasification temperature, may be zeolitic or non-zeolitic. It is preferable to use non-zeolitic active components when operating at high gasification temperatures, i.e. greater than about 765° C. (1400° F.). Non-limiting examples of non-zeolitic active components are amorphous silica-alumina, zirconia, gallia, silica-zirconia, etc. Representative crystalline zeolitic active components incude zeolite A (U.S. Pat. No. 2,882,243), zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,313,752), synthetic mordenite and dealuminized synthetic mordenite, merely to name a few, as well as naturally occurring zeolites, incuding chabazite, faujasite, mordenite, and the like. Preferred crystalline zeolites include the synthetic faujasite zeolites X and Y, with particular preference being accorded to zeolite Y. Metals such as cobalt, tungsten, nickel, vanadium, etc., may be associated with the zeolitic or non-zeolitic active components.

Additionally, members of a novel class of zeolites characterized by a silica to alumina mole ratio of at least 12 and a constraint index in the approximate range of 1 to 12 may be used directly as an active catalyst component or in combination with the aforementioned active components. This novel class of zeolites is exemplified by ZSM-5 (U.S. Pat. No. 3,702,886), ZSM-11 (U.S. Pat. No. 3,709,979), ZSM-12 (U.S. Pat. No. 3,832,449), ZSM-23 (U.S. Pat. No. 4,076,842), ZSM-35 (U.S. Pat. No. 4,016,245) and ZSM-38 (U.S. Pat. No. 4,046,859).

The crystalline zeolite employed as a constituent in the catalyst compositions of the present invention is essentially characterized by a high catalytic activity.

In general, the crystalline zeolites are ordinarily ion exchanged either separately or in the final catalyst form with a desired cation to replace alkali metal present in the zeolite as found naturally or as synthetically prepared. The exchange treatment is such as to reduce the alkali metal content of the final catalyst to less than about 1.5 weight percent and preferably less than about 0.5 weight percent. The purpose of ion exchange is to substantially remove alkali metal cations which are known to be deleterious to cracking, as well as to introduce particularly desired catalytic activity by means of the various cations used in the exchange medium. For the operation described herein, preferred cations are hydrogen, ammonium, rare earth and mixtures thereof, with particular preference being accorded to rare earth elements. Ion exchange is suitably accomplished by conventional contact of the zeolite with a suitable salt solution of the desired cation such as, for example, the sulfate, chloride or nitrate.

It is preferred to have the crystalline zeolite of the catalyst in a suitable matrix, since this desired catalyst form is generally characterized by a high resistance to attrition, high activity and exceptional steam stability. Such catalyst are readily prepared by dispersing the crystalline zeolite in a suitable siliceous sol and gelling the sol by various means. The inorganic oxide which serves as the matrix in which the above crystalline zeolite is distributed includes silica gel or a cogel of silica and a suitable metal oxide. Representative cogels include silica-alumina, silica-magnesia, silica-zirconia, silica-thoria, silica-beryllia, silica-titania, as well as ternary combinations such as silica-alumina-magnesia, silica-alumina-zirconia and silica-magnesia-zirconia. Preferred cogels include silica-alumina, silica-zirconia or silica-alumina-zirconia. The above gels and cogels will generally comprise a major proportion of silica and a minor proportion of the other aforementioned oxide or oxides. Thus, the silica content of the siliceous gel or cogel matrix will generally fall within the range of 55 to 100 weight percent, preferably 60 to 95 weight percent, and the other metal oxide or oxides content will generally be within the range of 0 to 45 weight percent and preferably 5 to 40 weight percent. In addition to the above, the matrix may also comprise natural or synthetic clays, such as kaolin type clays, montmorillonite, bentonite or halloysite. These clays may be used either alone or in combination with silica or any of the above specified cogels in matrix formulation.

Where a matrix is used, content of crystalline zeolite, e.g., the amount of the zeolite Y component, is generally between about 5 to about 50 weight percent. Ion exchange of the zeolite to replace its initial alkali metal content can be accomplished either prior to or subsequent to incorporation of the zeolite into the matrix. The above compositions may be readily processed so as to provide fluid catalysts by spray drying the composite to form microspheroidal particles of suitable size.

A particular aspect of the processing concepts of the present invention is concerned with providing a short contact time residual oil catalytic conversion operation in the presence of hydrogen at reasonable temperatures. Furthermore, utilization is made of the catalyst regeneration operation as a partial oxidation gasification function to provide some, if not all, of the necessary hydrogen for the overall process. The process concepts of the instant invention are considerably different from fluid catalytic cracking (FCC) operations in that hydrogen is employed in the reaction zone of the process of present invention; the process of this invention is generally conducted at higher pressures than FCC operations; and hydrogen containing gas is produced in the regeneration zone of the process of the instant invention.

Referring now to the drawing, by way of example, there is shown a side-by-side reactor-regenerator system with shifter for maximizing hydrogen gas made. Feedstock, namely resid, and hydrogen containing gas, e.g., synthesis gas or pure hydrogen, is fed via conduit 1 to a riser reactor 2 for admixture and contact with a large amount of hot, solid catalyst particles introduced by conduit 8 at a temperature in the range of between about 540° C. (1000° F.) and 990° C. (1800° F.), preferably from between about 600° C. (1100° F.) and 820° C. (1500° F.) to form a suspension. Catalyst to oil ratios may be maintained within the range of between about 2 and 15, preferably from between about 5 and 10. The hydrogen pressure is maintained within the range of between about 790 kPa (100 psig) and about 7000 kPa (1000 psig), preferably from between about 1480 kPa (200 psig) and 2860 kPa (400 psig). The hot active catalyst particles serve to break condensed aromatic ring structures in the feedstock and the thusly formed fragments are intercepted by hydrogen to yield aromatics of smaller ring content before they can condense into graphitic substances. The temperature rise of the hydrocarbon fluid within the reactor is very rapid desirably about 500° F. per second, or faster. This heat-up rate may be varied, however, depending on the temperature of the feedstock and the temperature of the regenerated catalyst solids, as well as the catalyst to oil ratio employed. Depending on the particular operating conditions employed, considerable reduction in the contaminate levels of the feedstock can be attained. Thus it would be possible to substantially free the hydrocarbon feedstock from metals and high CCR contamination. Furthermore, desulfurization and denitrogenation of the feedstock will also occur in the riser, producing a relatively clean product. The oil residence time in the reactor is within the range of between about 1 second and 30 seconds, preferably from between about 5 seconds and 20 seconds.

The means used to separate the products from the coked catalyst 5 is located at the top of the riser reactor 2, in separation zone 3, and such means may include any suitable means known in the prior art such as, for example, cyclones. The products are withdrawn from the separation zone 3 through conduit 4.

The catalyst containing coke deposits from cracking the feedstock, pass from the separation zone 3 through line 5 to a catalyst regenerator 6 (also referred to herein as the regeneration or gasification zone). In the regeneration/gasification zone 6, the coked catalyst comes into contact with a stream of oxygen-containing gas, e.g., pure oxygen or air, and steam which enter the zone via conduit 7. The regenerator operates as a fluidized bed and behaves as a partial oxidation gasifier to produce a synthesis gas which is withdrawn through line 9. The gasification reactions occurring in the regenerator 6 are well known and include the following:

(1) $C+2H_2O \rightarrow CO_2+2H_2$;
(2) $2C+1\frac{1}{2}O_2 \rightarrow CO_2+CO$;
(3) $CO_2+C \rightarrow 2CO$; and
(4) $CO+H_2O \rightarrow CO_2+H_2$ Reactions (1) and (3) are endothermic reactions, while reactions (2) and (4) are exothermic reactions. The temperature in the regenerator 6 is maintained within the range of between about 700° C. (1300° F.) and 1200° C. (2280° F.), and preferably is sufficiently high to heat the catalyst so that the hot catalyst can in turn heat the resid feed to a desired reaction temperature of between about 485° C. (900° F.) and 710° C. (1300° F.), preferably from between about 540° C. (1000° F.) and 655° C. (1200° F.). The hot regenerated catalyst then passes directly from the regeneration/gasification zone 6 through conduit 9 to the bottom portion of the riser reactor 2 for admixture with the feedstock and hydrogen as mentioned hereinbefore. In one embodiment, existing equipment comprising a fluid catalytic cracking (FCC) unit can be utilized to conduct the novel process of the present invention.

The synthesis gas from the regenerator is comprised of CO, $CO_2$ and $H_2O$. In the shifter 10 (water-gas shift reactor), a synthesis gas rich in hydrogen and carbon dioxide is produced via the well-known shift reaction:

$$CO+H_2O \rightarrow CO_2+H_2$$

The synthesis gas thus produced is recovered and withdrawn by conduit 11. Hydrogen gas may be separated from the other components of the synthesis gas, e.g., $CO_2$, and recycled back to the riser 2 through conduit 1. Alternatively, the hydrogen-carbon dioxide rich shifted synthesis gas may be utilized in the riser as a source of hydrogen.

What is claimed is:

1. A process for converting residual oils to lower boiling components which comprises:

(a) combining petroleum residual oil and hydrogen containing gas with hot solid catalyst particles at a temperature of between about 1000° F. and 1800° F., the ratio of catalyst to oil being within the range of between about 2 and 15, with hydrogen pressure being maintained within the range of between about 100 psig and 1000 psig, to form a suspension;
(b) passing the suspension through a reactor arrangement providing an oil residence time of between about 1 second and 30 seconds;
(c) separating and recovering said lower boiling components and said solid catalyst particles;
(d) gasifying and regenerating the separated solid catalyst particles with a mixture of oxygen-containing gas and steam in a fluidized bed operating in a partial oxidation mode to produce synthesis gas and regenerated catalyst;
(e) recovering said synthesis gas;
(f) directly returning the regenerated catalyst to combine with the residual oil and hydrogen in said reactor arrangement.

2. The process of claim 1 wherein the temperature of said hot solid catalyst particles is between about 1100° F. and 1500° F.

3. The process of claim 1 wherein said catalyst to oil ratio is between about 5 and 10.

4. The process of claim 1 wherein said hydrogen pressure is between about 200 psig and 400 psig.

5. The process of claim 1 wherein said oil residence time in the reactor is between about 5 seconds and 20 seconds.

6. The process of claim 1 wherein said reactor is a riser reactor.

7. The process of claim 1 wherein the hydrogen containing gas is synthesis gas.

8. The process of claim 1 wherein the catalyst comprises a non-zeolitic active component.

9. The process of claim 1 wherein said catalyst comprises a zeolitic active component.

10. The process of claim 1 wherein said catalyst is contained in a matrix.

11. The process of claim 1 wherein the separating and recovering of the lower boiling components and the solid catalyst particles are accomplished by utilization of cyclonic means.

12. The process of claim 1 wherein the regenerating of said catalyst particles is conducted at a temperature of between about 1300° F. and 2200° F.

13. The process of claim 1 wherein said oxygen-containing gas is air.

14. The process of claim 1 wherein said conversion of residual oils and catalyst regeneration is conducted in a fluid catalytic cracking unit.

15. The process of claim 1 wherein said synthesis gas undergoes the water-gas shift reaction.

16. The process of claim 15 wherein the shifted synthesis gas is recycled to the reactor to serve as a source of hydrogen.

* * * * *